US007431430B2

(12) United States Patent
Eguchi et al.

(10) Patent No.: US 7,431,430 B2
(45) Date of Patent: Oct. 7, 2008

(54) LIQUID EJECTING HEAD HAVING SELECTIVELY CONTROLLED HEAT-ENERGY EVOLVING ELEMENT REGIONS

(75) Inventors: Takeo Eguchi, Kanagawa (JP); Manabu Tomita, Kanagawa (JP); Minoru Kohno, Tokyo (JP); Takaaki Miyamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 213 days.

(21) Appl. No.: 10/530,633

(22) PCT Filed: Oct. 8, 2003

(86) PCT No.: PCT/JP03/12905

§ 371 (c)(1),
(2), (4) Date: Aug. 18, 2005

(87) PCT Pub. No.: WO2004/033212

PCT Pub. Date: Apr. 22, 2004

(65) Prior Publication Data

US 2006/0146094 A1 Jul. 6, 2006

(30) Foreign Application Priority Data

Oct. 8, 2002 (JP) ..... 2002-295342

(51) Int. Cl.
*B41J 2/05* (2006.01)

(52) U.S. Cl. ..... 347/56; 347/62

(58) Field of Classification Search ..... 347/20, 347/56, 61–65, 67; 219/216; 257/363, 379, 257/516; 392/303, 338
See application file for complete search history.

(56) References Cited

FOREIGN PATENT DOCUMENTS

| | | | |
|---|---|---|---|
| EP | 0124312 | * 7/1984 | ..... 347/62 |
| JP | 55-132259 | 10/1980 | |
| JP | 59-207262 | 11/1984 | |
| JP | 05-208496 | 8/1993 | |
| JP | 08-216412 | 8/1996 | |
| JP | 09-048121 | 2/1997 | |
| JP | 09-239983 | 9/1997 | |
| JP | 2000-185403 | 7/2000 | |
| JP | 2001-105584 | 4/2001 | |
| JP | 2002-240287 | 8/2002 | |

* cited by examiner

*Primary Examiner*—Juanita D Stephens
(74) *Attorney, Agent, or Firm*—Sonnenschein Nath & Rosenthal LLP

(57) ABSTRACT

A liquid ejecting head having a plurality of heat evolving elements formed on an integral substrate without being divided into more than one part, so that it is capable of controlling the direction of liquid ejection. The liquid ejecting head has heat-energy evolving elements (22) that evolve heat energy to eject liquid. The heat-energy evolving elements (22) are constructed of an integral substrate, assume a zigzag pattern (in plan view), and have conductors or electrodes (36) connected thereto at the turnaround part of the zigzag pattern, so that they are divided into main parts (22*a*, 22*b*) to evolve heat energy to eject liquid. Each of the heat-evolving elements has thereon a nozzle through which liquid is ejected.

11 Claims, 16 Drawing Sheets

LIQUID EJECTING HEAD HAVING SELECTIVELY CONTROLLED HEAT-ENERGY EVOLVING ELEMENT REGIONS

The present invention relates to a liquid ejecting head for ejection of liquid by means of heat energy, which is employed for liquid ejecting apparatus such as inkjet printers, and also to a liquid ejecting apparatus provided with the liquid ejecting head.

Among conventional liquid ejecting apparatus such as inkjet printers is that of thermal type which is designed to eject liquid by means of a pressure of bubbles evolved by rapid heating of liquid with a heating element.

The heating element may assume different forms. It may be a single entity or an assemblage of two or more parts placed in one liquid chamber. (See Patent Document 1 (Japanese Patent Laid-open No. Hei 8-118641).)

Conventional heating elements may take on rectangular shapes as shown in FIGS. 13A to 13C which are plan views. The one shown in FIG. 13A consists of a single component 1 which assumes a nearly square plane. The one shown in FIG. 13B consists of two components 1A and 1B divided in a nearly square region. The one shown in FIG. 13C consists of three components 1C, 1D, and 1E divided in a nearly square region.

The heating element shown in FIG. 13A has electrodes 2 attached to both ends thereof so that it is supplied with current through them. (The electrodes are indicated by ① and ② in the figure.)

The heating element shown in FIG. 13B has electrodes 2A and 2B attached thereto as follows. The electrodes 2A (① and ③) are attached to one end of each of the components 1A and 1B, and the electrode 2B (②) is attached to the other ends of the components 1A and 1B so that it connects them together.

Moreover, the heating element shown in FIG. 13C has electrodes 2C, 2D, and 2E attached thereto as follows. The electrodes 2C (① and ④) are attached to one end of each of the components 1C and 1E. The electrode 2D (②) is attached to the ends of the components 1C and 1D so that it connects them together. The electrode 2E (③) is attached to the ends of the components 1D and 1E so that it connects them together.

FIGS. 13B and 13C indicate that the heating element consisting of two or three components (1A to 1D) is constructed such that the components are connected together in series. In the heating element shown in FIG. 13B, for example, current applied across the two electrodes 2A flows through the electrode 2B, thereby heating both of the components 1A and 1B simultaneously.

Unfortunately, the conventional heating element (shown in FIG. 13A) consisting of a single component suffers the problem with a low resistance, as illustrated below. In the case of three heating elements individually formed in a square of the same area as shown in FIGS. 13A to 13C, the first one (FIG. 13A), which consists of a single component, has a resistance smaller than one-forth that of the second one (FIG. 13B), which consists of two components, and smaller than one-ninth that of the third one (FIG. 13C), which consists of three components. This implies that the heating element consisting of a single component needs low-voltage current more in proportion to is low resistance, and hence it is vulnerable to power loss and voltage drop. Therefore, the heating element of this type is not suitable for an apparatus in which many nozzles are juxtaposed.

It is to be noted that the heating elements shown in FIGS. 13A to 13C do not evolve heat from their entire surface upon voltage application. The area that effectively contributes to liquid ejection is limited as indicated by dotted lines. The result is that the heating element consisting of two divided components, as shown in FIG. 13B, has an area (a slit between 1A and 1B) where there exists no heating elements. This implies that the central part of the heating element remains at a low temperature.

On the other hand, heating elements juxtaposed on a substrate suffer the disadvantage of involving difficulties with fabricating process to make uniform their heating characteristics. In other words, they vary in performance. In addition, the more the heating element is divided into components, the more exist the regions generating no heat. To compensate this, it is necessary to raise the temperature per unit area of the heating element. This, in turn, rapidly deteriorates the heating element.

The foregoing suggests that a square one-piece heating element has an advantage over a multi-piece heating element except that it needs a specific power source. In practice, it is known to eject liquid rather uniformly.

The present applicant had previously proposed a method for controlling the direction of ejection by means of a plurality of heating elements placed in one liquid chamber. (See Japanese Patent Application Nos. 2002-112947 and 2002-161928.) This method, however, does not achieve its objective easily with one-piece heating elements formed in a shape resembling a square.

SUMMARY OF THE INVENTION

The present inventors tackled the foregoing problem by employing a plurality of heating elements (of one-piece type) which are so formed on a single substrate as to control the direction of ejection. The object of the present invention to solve the problem is achieved by what is defined in the following.

The first embodiment of the present invention is concerned with a liquid ejecting head having heat-energy evolving elements that evolve heat energy to eject liquid, wherein the heat-energy evolving elements are constructed of an integral substrate, assume a zigzag pattern (in plan view), and have conductors connected thereto at the turnaround part of the zigzag pattern, and each of the elements has thereon a nozzle through which liquid is ejected.

According to the present invention, the heat energy evolving elements are divided into a plurality of segments by the conductor which is formed at the turnaround part of the zigzag pattern. In other words, those parts of the substrate which are adjacent to each other, with the turnaround part between, substantially function as the heat evolving parts which evolve heat energy to eject liquid. Because of this structure, the heating elements function as if the heat evolving parts are connected in series through the conductor.

Another embodiment of the present invention is concerned with a liquid ejecting apparatus having heat-energy evolving elements that evolve heat energy to eject liquid, wherein the heat-energy evolving elements are constructed of an integral substrate, assume a zigzag pattern (in plan view), and have conductors connected thereto at the turnaround part of the zigzag pattern such that the major part evolving heat energy to eject liquid is divided into at least two parts by the turnaround part of the zigzag pattern, and each of the elements has thereon a nozzle through which liquid is ejected, the liquid ejecting apparatus further having a primary control means which causes the heat energy evolving elements to evolve heat energy, thereby ejecting liquid on the heat energy ejecting element through the nozzle, and a secondary control means which causes at least the two major parts to evolve heat energy differing in heat energy characteristics and to change the distribution of heat energy imparted to the liquid on the heat energy evolving element, thereby controlling the direction of ejection of the liquid ejected from the nozzle.

According to the present invention, the heat energy evolving elements are divided into at least two main parts to evolve heat energy to eject liquid by the conductor which is formed at the turnaround part of the zigzag pattern. In other words, those parts adjacent to each other, with the turnaround part between, substantially function as the heat evolving parts which evolve heat energy to eject liquid. Because of this structure, the heating elements function as if the main parts are connected in series through the conductor.

The primary control means controls ejection of liquid, and the secondary control means causes the heat energy evolved by the main parts to vary in heat energy characteristics. In this way it is possible to change the distribution of heat energy on the heat evolving elements and to control the direction of ejection of liquid ejected from the nozzle.

Another embodiment of the present invention is concerned with a process for producing a liquid ejecting head for ejection of liquid from a nozzle by means of heat energy evolved by a heat energy evolving element, wherein the heat-energy evolving elements are constructed of an integral substrate, assume a zigzag pattern (in plan view), and have conductors connected thereto at the turnaround part of the zigzag pattern such that the heat-evolving element is divided into at least two parts which evolve heat energy for liquid ejection.

BRIEF DESCRIPTION OF THE DRAWINGS

FIG. 4A shows the entire structure, and FIG. 4B shows an equivalent circuit for analysis.

DETAILED DESCRIPTION OF THE PRESENTLY PREFERRED EMBODIMENTS

Figure 1:
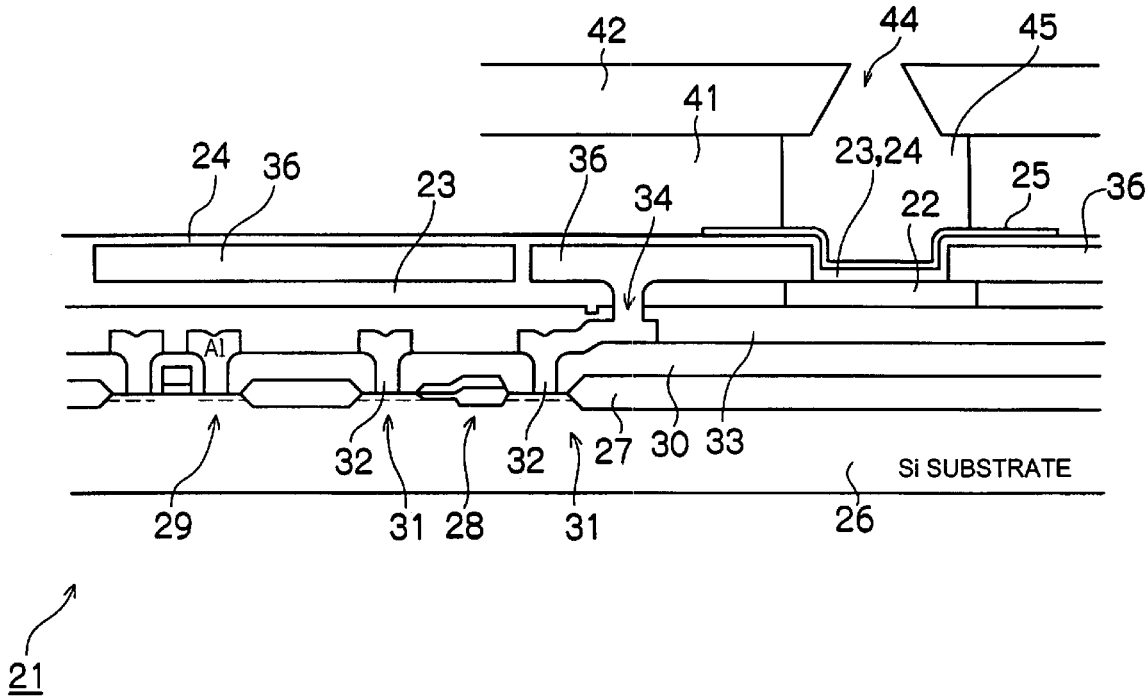
FIG. 1 is a sectional view showing the layer structure of the head.

A description will be given below of one embodiment of the present invention with reference to the accompanying drawings.

The configuration and the fabrication method of the liquid ejecting head (hereinafter, abbreviated as "head") will be described first. The head 21 has a sectional layer structure shown in FIG. 1, and it is fabricated by several steps which are sequentially shown in FIGS. 2A to 2G.

Fabrication starts with the first step of forming silicon nitride film ($Si_3N_4$) on a p-type silicon substrate 26 (wafer). The silicon substrate 26 undergoes lithography and reactive etching steps so that the silicon nitride film is removed by thermal oxidation except for that in the region where transistors are formed. Thus, the silicon nitride film remains only in the region where transistors are formed on the silicon substrate 26.

In the next step, silicon oxide film is formed in the region where the silicon nitride film has been removed by thermal oxidation. This silicon oxide film functions as the element isolating region 27 to isolates transistors from one another. In the transistor-forming region is formed the gate in layer structure composed of tungsten silicide, polysilicon, and thermal oxidation. The silicon substrate 26 undergoes ion implantation and oxidation so that the source-drain region is formed. In this way the MOS type transistors 28 and 29 are formed.

Here, the transistor 28 is a driver transistor to drive the heating element 22 (or heat-energy evolving element), and the transistor 29 is a transistor constituting the integrated circuit that controls the transistor 28. Incidentally, the transistor 28 in this embodiment has a low-concentration diffusion layer between the gate and the drain which relieves the electrolysis due to electrons accelerated in this region, so that necessary breakdown voltage is secured.

The transistors 28 and 29, which have been formed on the silicon substrate 26 as mentioned above, are covered sequentially with PSG film and BPSG film 30, which constitute the first interlayer insulating film. The PSG film is a silicon oxide film containing silicon added by CVD process. The BPSG film is a silicon oxide film containing boron and phosphorus.

Reactive etching with $C_4F_8/CO/O_2/Ar$ gases, which follows photolithography, is performed to make the contact hole 31 on the silicon semiconductor diffusion layer (source-drain).

Layers of titanium, titanium nitride barrier metal, titanium, and silicon- or copper-containing aluminum are formed sequentially. The top layer is covered with an anti-reflection coating of titanium nitride. These laminate layers serve for wiring pattern. The wiring pattern layer is selectively removed by photolithography and dry etching, so that the first wiring pattern 32 is formed. With the first wiring pattern 32 connected to the transistor 29 constituting the driving circuit, the logic integrated circuit is formed.

CVD process with TEOS (tetraethoxysilane $Si(OC_2H_5)_4$) is performed to form the interlayer insulating film 33 of silicon oxide. The interlayer insulating film 33 is planarized by coating (with a coat-type silicon oxide including SOG) and ensuing etchback. This step is repeated twice. In this way the interlayer insulating film 33 is formed between the first wiring pattern 32 and the second wiring pattern.

Figure 2A:
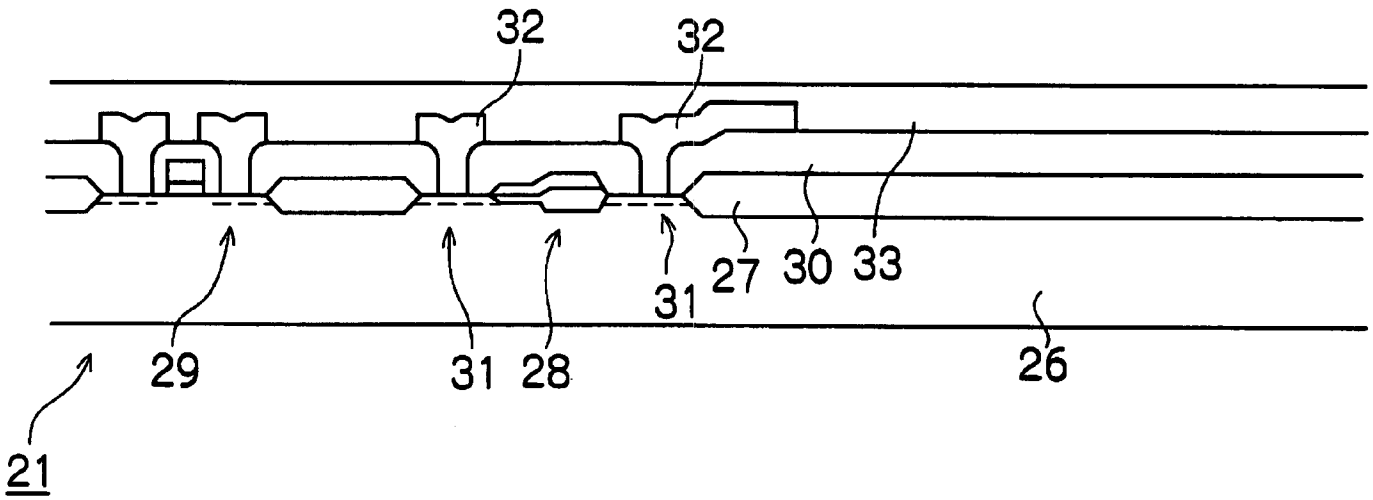
FIGS. 2A to 2G are sectional views showing the layer structure in each step of fabricating the head.
Figure 2B:
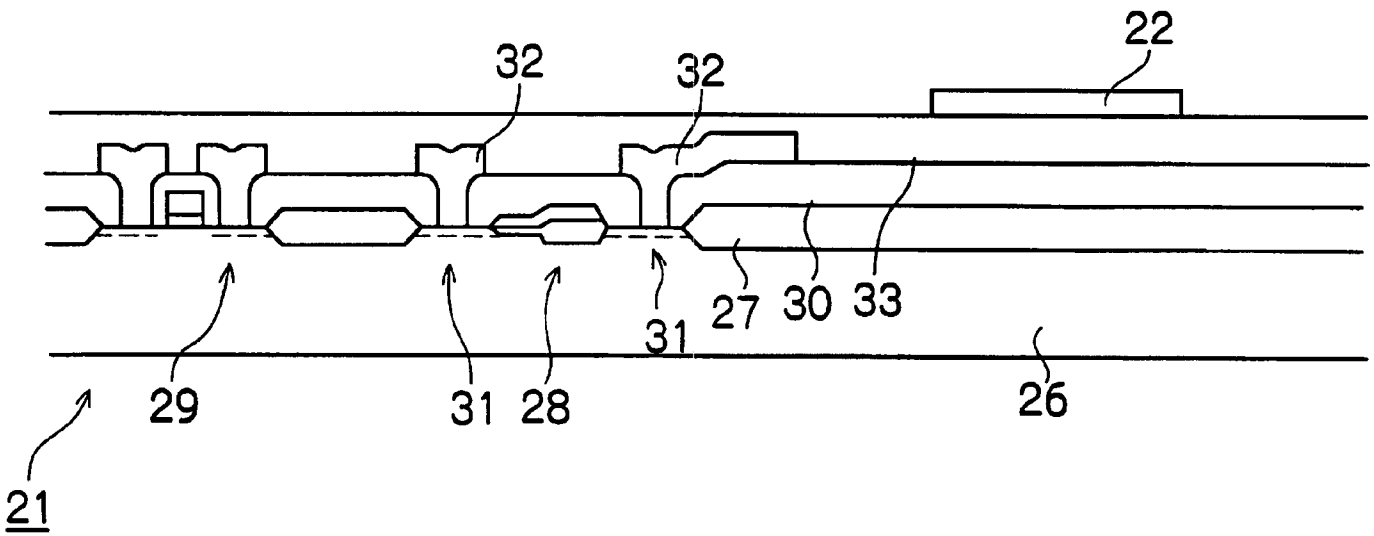

In the step shown in FIG. 2B, a tantalum film is formed by sputtering on the interlayer insulating film 33. An unnecessary part of the tantalum film is removed by photolithography and dry etching with $BCl_3/Cl_2$ gas. In this way the heat evolving element 22 is formed.

Figure 2C:
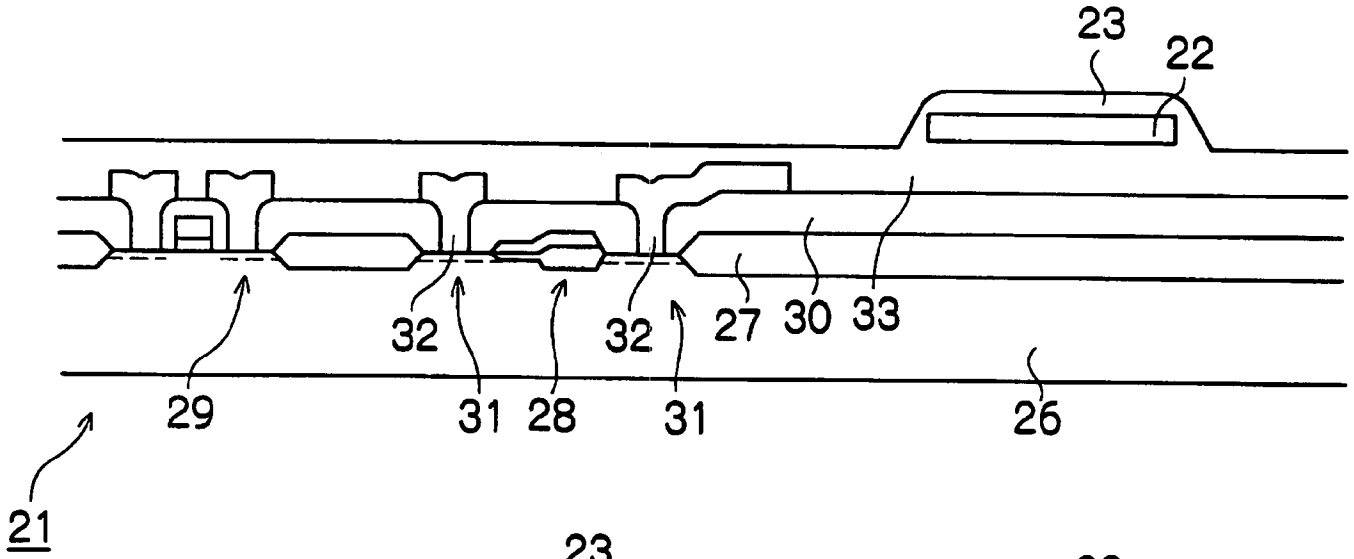
Figure 2D:
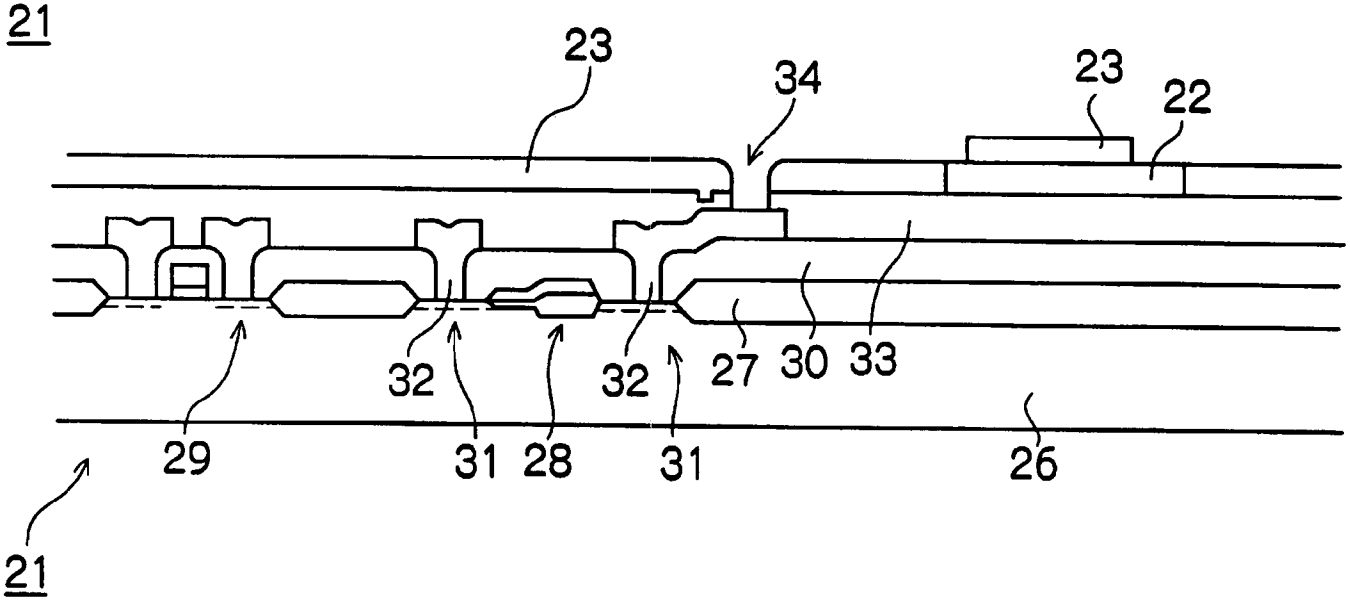

In the step shown in FIG. 2C, a silicon nitride film is formed by CVD process. It serves as the protective film 23 for the heat evolving element 22. In the next step shown in FIG. 2D, specific parts of the silicon nitride film are removed by photolithography and dry etching with $CHF_3/CF_4/Ar$ gas, so that the region for connection to the wiring pattern (electrode) of the heat evolving element 22 is exposed. The via hole 34 is made in the interlayer insulating film 33.

Figure 2E:
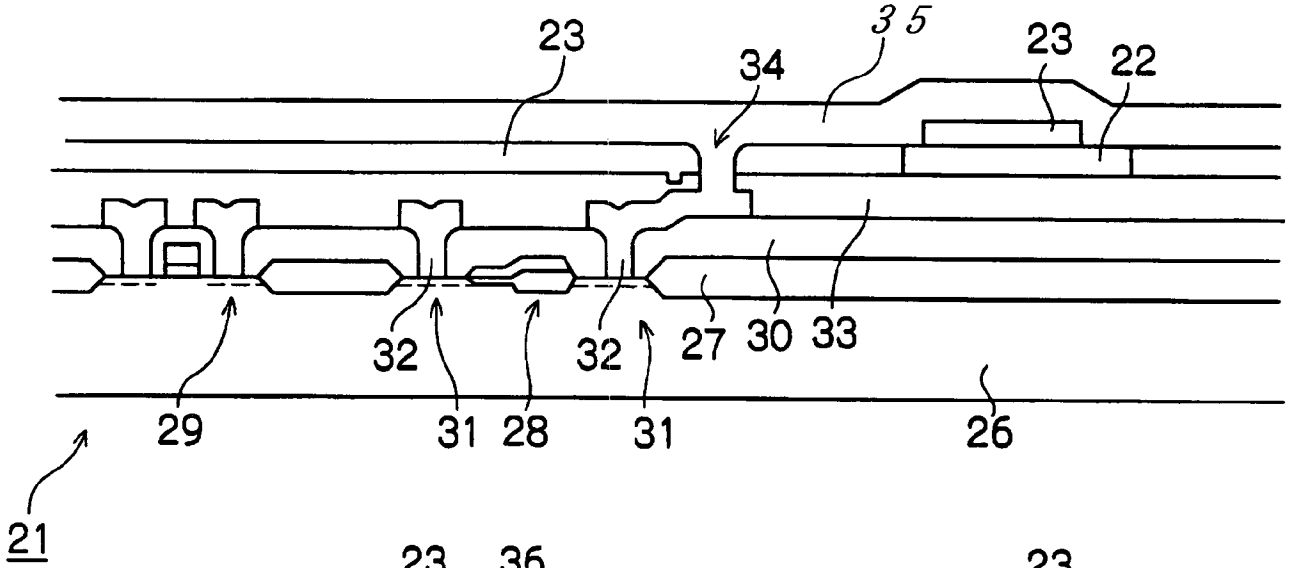

In the step shown in FIG. 2E, sputtering is performed to form a layer of aluminum containing titanium, silicon, or copper. This layer is covered with a titanium nitride film, which serves as the anti-reflection film. In this way the wiring pattern 35 is formed in the head 21.

Figure 2F:
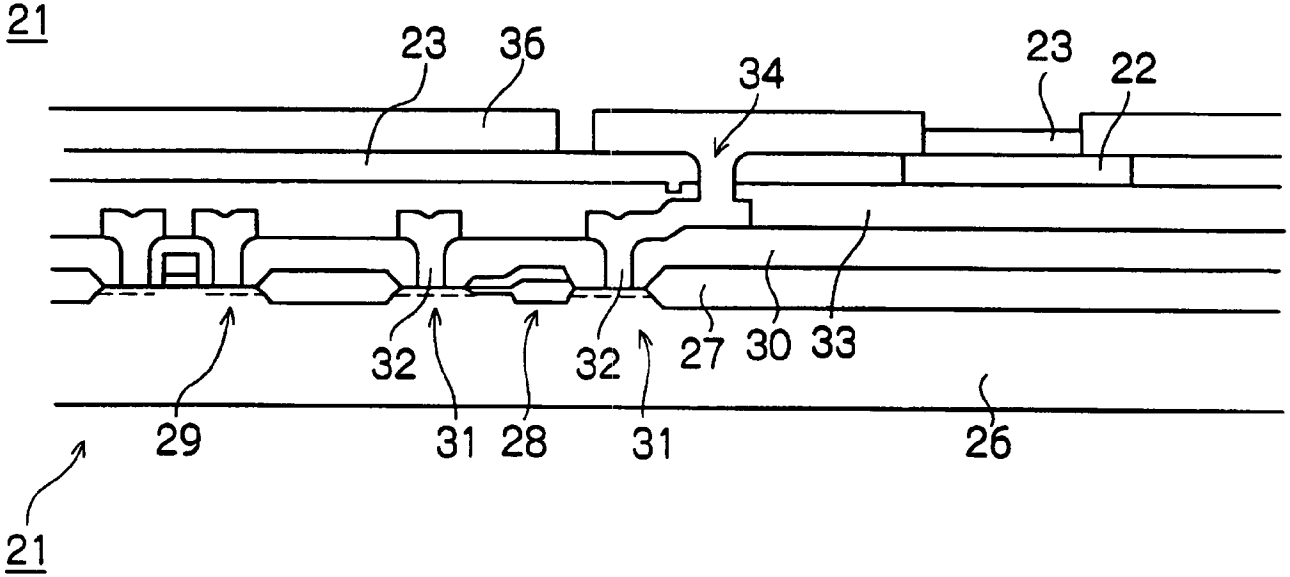

In the step shown in FIG. 2F, the wiring pattern 35, which has been formed by photolithography and dry etching, is selectively removed, so that the second wiring pattern (for the electrode 36) is formed. The wiring patterns for power source and grounding are formed by using the electrode 36 as a mask, and the wiring pattern to connect the transistor 28 to the heat evolving element 22 is formed. Incidentally, the protective layer 23 of silicon nitride, which remains on the upper layer of the heat evolving element 22, protects the heat evolving element 22 in the etching step to form the electrode 36.

Figure 2G:
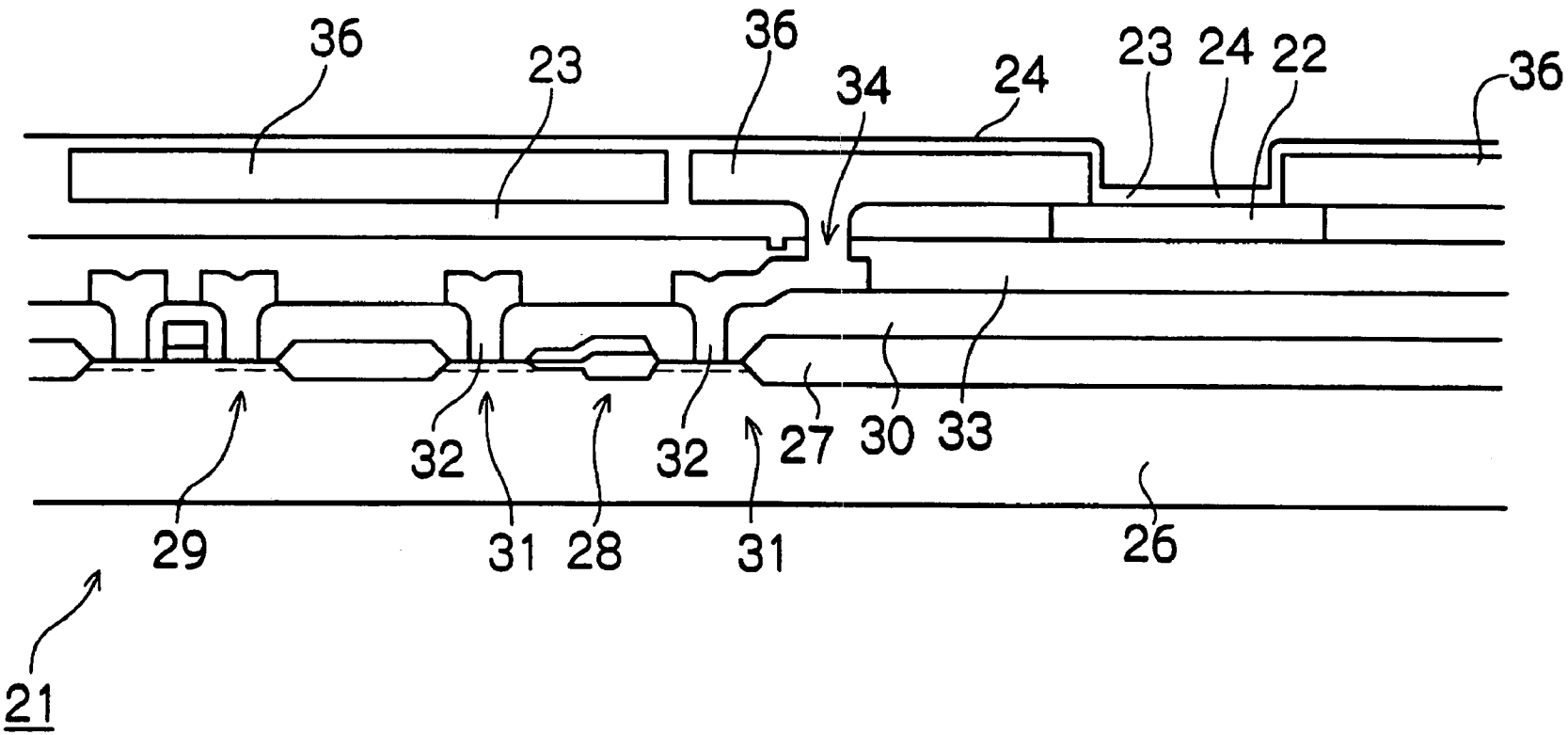

In the step shown in FIG. 2G, the protective layer 24 of silicon nitride (which functions as the ink protecting layer) is formed by CVD process. The substrate undergoes heat treatment in a furnace with an atmosphere of nitrogen or hydrogen-containing nitrogen. This heat treatment is intended to ensure stable operations of the transistors 28 and 29 and to secure good connection with the first wiring pattern 32 and the second wiring pattern 36 (as the electrode 36), thereby reducing contact resistance.

Subsequent steps are carried out to form several parts as shown in FIG. 1. On the heat evolving element 22 is formed the anti-cavitation layer 25 from tantalum by sputtering. Then, the dry film 41 and orifice plate 42 are sequentially formed. The dry film 41 is an organic resin film attached to the desired position by pressing; it is cured after removal of those parts corresponding to the ink chamber 45 and the ink duct (not shown). The orifice plate 42 is a flat sheet having the nozzle 44 (a tiny ink ejection hole) made above the heat evolving element 22. It is bonded to the dry film 41. The resulting head includes the nozzle 44, the ink chamber 45, and the ink duct that leads ink to the ink chamber 45.

Thus the heat evolving element 22 of the head 21 has the layer structure including the anti-cavitation layer 25 of tantalum, the protective layers 23 and 24 of silicon nitride, the heat evolving element 22 of tantalum, and the silicon oxide films (the interlayer insulating film 33, the BPSG film 30, and the element isolating region 27), which are arranged downward from the ink chamber 45 on the silicon substrate 26.

In the head fabricated as mentioned above, each ink chamber 45 has one heat evolving element 22 and one nozzle 44 above the heat evolving element 22.

Figure 3:
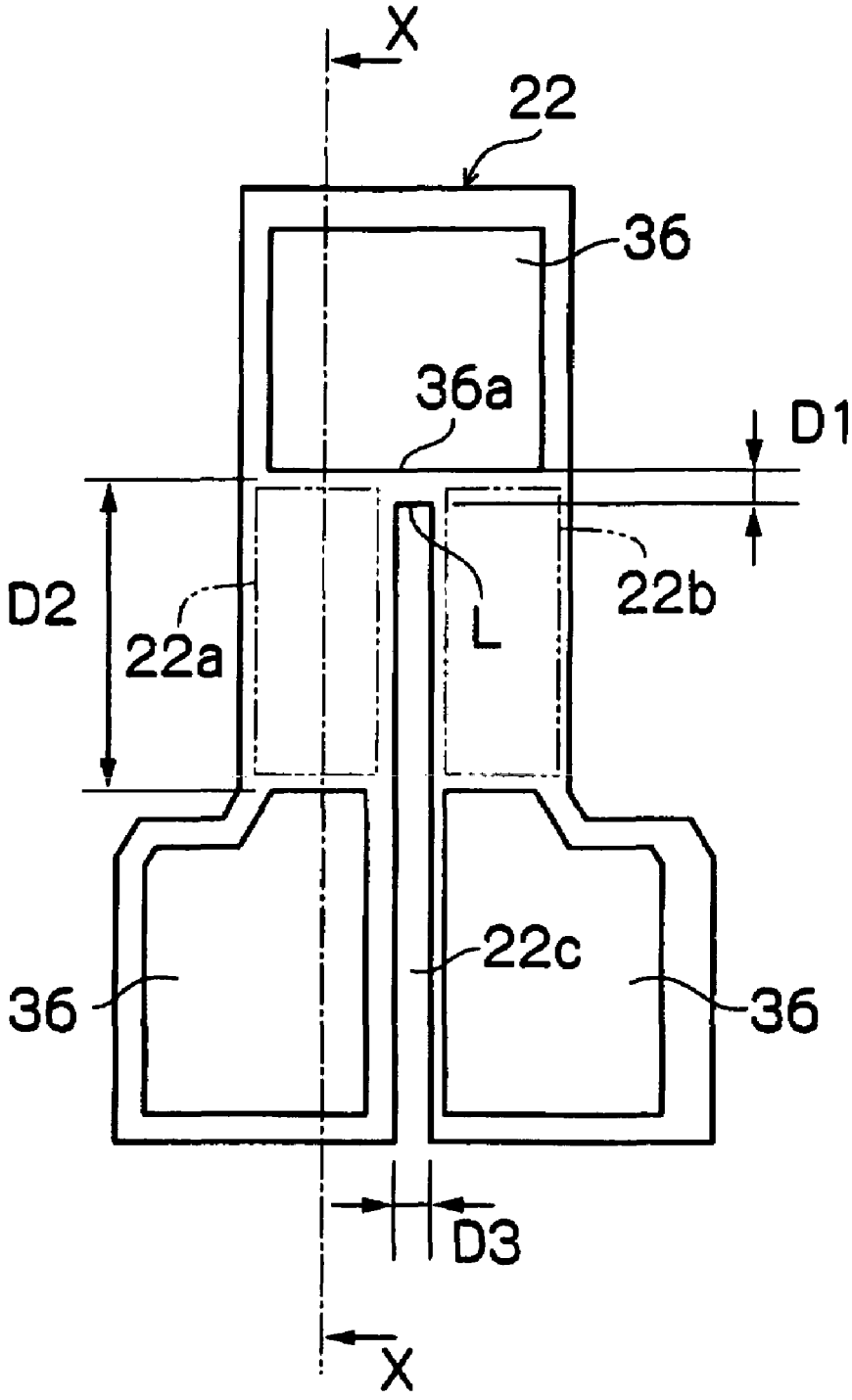
FIG. 3 is a plan view of the heating element.

A detailed description will be given below of the heat evolving element 22 which is shown in FIG. 3 (plan view). Incidentally, the cross section taken along the line X-X is shown in FIG. 1.

As shown in FIG. 3, the heat evolving element 22 includes a single undivided substrate 1, and it assumes a zigzag pattern in plan view. The zigzag pattern may look like a character ц, U, N, or W, which may be upright, inverted, or inclined. The zigzag pattern shown in FIG. 3 is an inverted ц-shape having the slit 22*c* extending upward from the center of the lower side.

In FIG. 3, there are shown three electrodes (conductors) 36, two of which are at the lower prongs of the inverted ц-shape and one of which is at the turnaround part of the zigzag pattern (or the upper part the spacing D1 away above the top end of the slit 22*c* in FIG. 3). These electrodes 36 are formed on the heat evolving element 22.

Figures 13A, 13B, 13C:
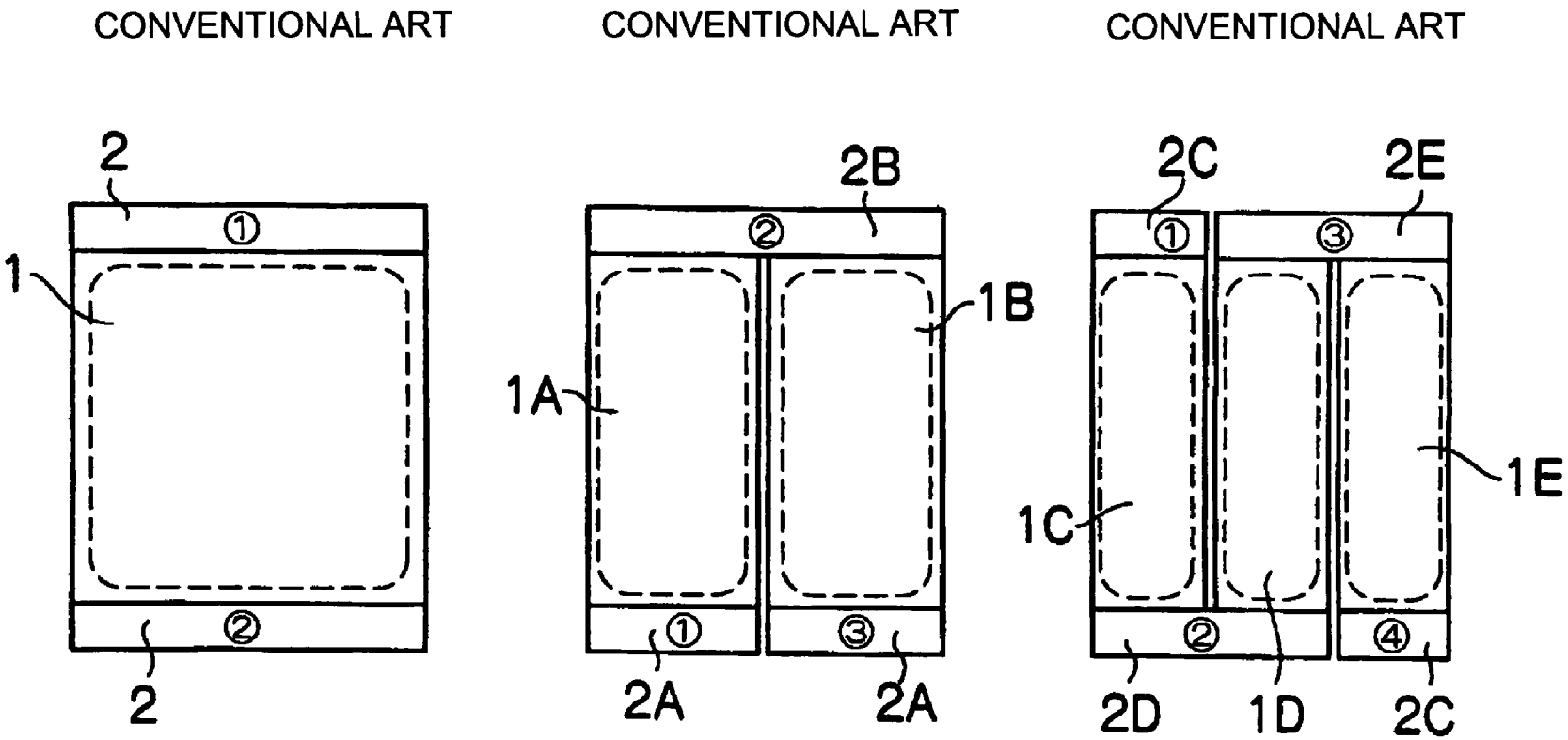
FIGS. 13A to 13C are plan views showing the heating elements of related art, which are of one-piece, two-piece, and three-piece structure, respectively.

The substrate of the heat evolving element 22 is an integral one; however, the electrodes 36 arranged as mentioned above make it resemble the segmented heat evolving elements 1A and 1B shown in FIG. 13B. The two parts surrounded by a chain double-dashed line in FIG. 3 are the parts 22*a* and 22*b* that evolve heat energy to eject ink. (These parts will be referred to as "main heat evolving parts" hereinafter.) The main heat evolving parts 22*a* and 22*b* are connected to each other through the electrode 36 formed at the turnaround part of the zigzag pattern.

In addition, it is desirable that the main heat evolving parts 22*a* and 22*b* should be juxtaposed as shown in FIG. 3. This arrangement of the main heat evolving parts 22*a* and 22*b* is similar to that of the two-piece heat evolving elements 1A and 1B shown in FIG. 13B.

In addition, as shown in FIG. 3, the electrode 36 at the turnaround part of the zigzag pattern is in the region outside the top end (L) of the slit 22*c* between the prongs of the ц-shaped pattern of the heat evolving element 22. In other words, there is the spacing D1 (which is greater than 0 mm) between the L and the edge 36*a* of the electrode 36.

The following explains the reason why the spacing (D1) should be greater than 0 mm.

The related-art process for producing the head 21 includes coating the heat evolving element 22 with aluminum and then removing aluminum covering the heat evolving element 22 by dissolution with a chemical agent. The disadvantage of this process is that pure aluminum is weak and liable to break. To ensure sufficient strength, pure aluminum is replaced by aluminum alloy with silicon or copper, thereby preventing the breakage.

Such aluminum alloy, however, leaves silicon or copper as dust on the heat evolving element 22 when it is dissolved by a chemical agent.

As an alternative method, dry etching is employed to remove aluminum, because dry etching causes silicon or copper to combine with aluminum chloride and blow away resulting residues.

Dry etching, however, requires the heat evolving element 22 to be protected by the protective layer 23 of silicon nitride because it slightly attacks the heat evolving element 22 of tantalum. Dry etching also attacks that part of the underlying silicon oxide film (such as the interlayer insulating film 33) which is not covered by the heat evolving element 22 when the via hole 34 is made. The attacked part results in an unnecessary step which cannot be filled with the protective layer 23. This brings about poor insulation.

The foregoing trouble is avoided by forming the electrode 36 of aluminum in that region of the heat evolving element 22 which is outside the top end (L) of the slit dividing the prongs of the ц-shaped pattern.

The spacing (D1) exceeding 0 mm produces the following effect. Current applied to the heat evolving element 22 flows from the main heat evolving part 22*a* to the main heat evolving part 22*b* through the electrode 36 and the spacing D1. As the spacing D1 becomes larger, current concentrates more at this part, thereby changing the state of heat evolution in the region of the heat evolving element 22. Therefore, with the spacing D1 optimized, it will be possible to optimize the distribution of heat evolution in the region of the heat evolving element 22.

The advantage of the heat evolving element 22 which is not divided but includes the main heat evolving parts 22*a* and 22*b* continuous through the spacing D1 is that there occurs less variation in flush at the time of current application and there exist less satellites.

An optimal value of the spacing D1 may be established as follows.

Figure 4B:
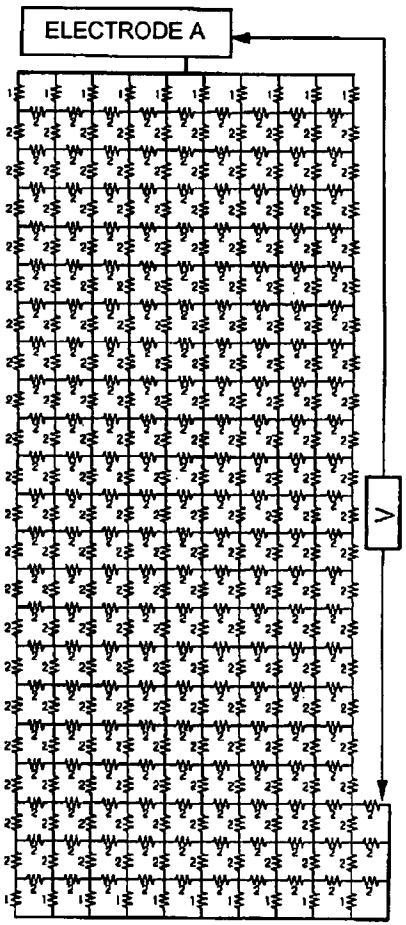
FIGS. 4A and 4B are resistor networks representing the heating elements.
Figure 4A:
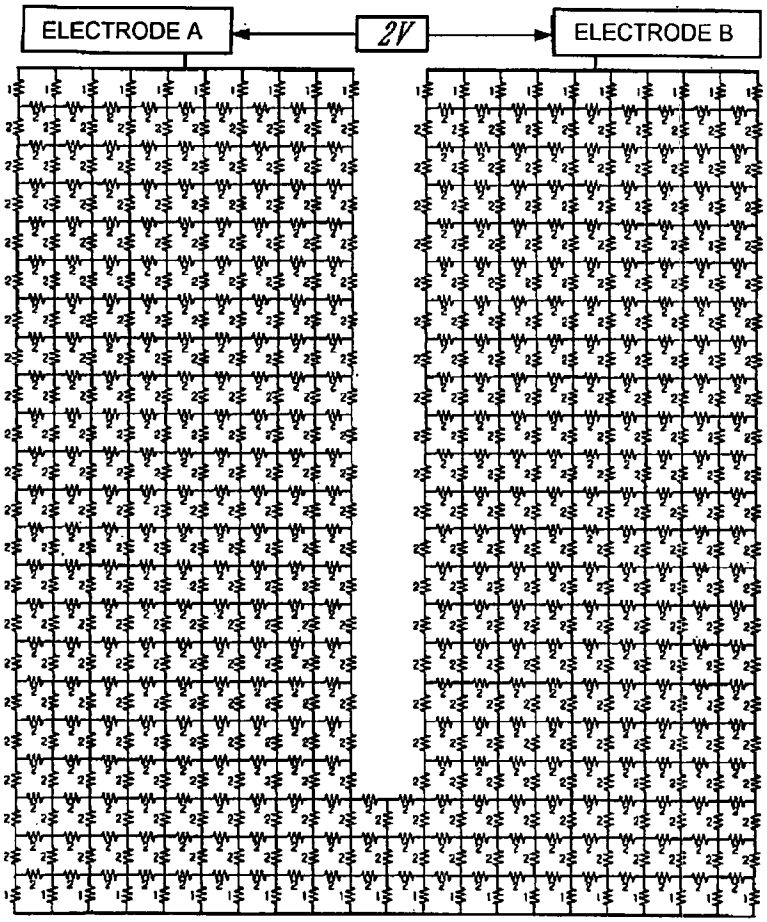
Figure 5B:
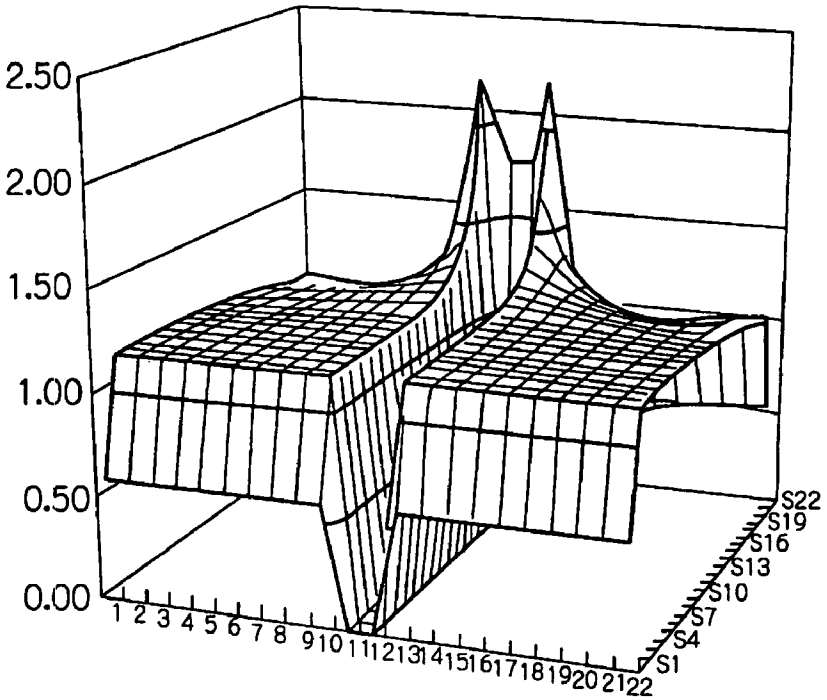
FIGS. 5A and 5B are diagrams showing the distribution of calorific value. These diagrams were obtained from a sample in which the spacing D1 is 2.5 μm.
Figure 5A:
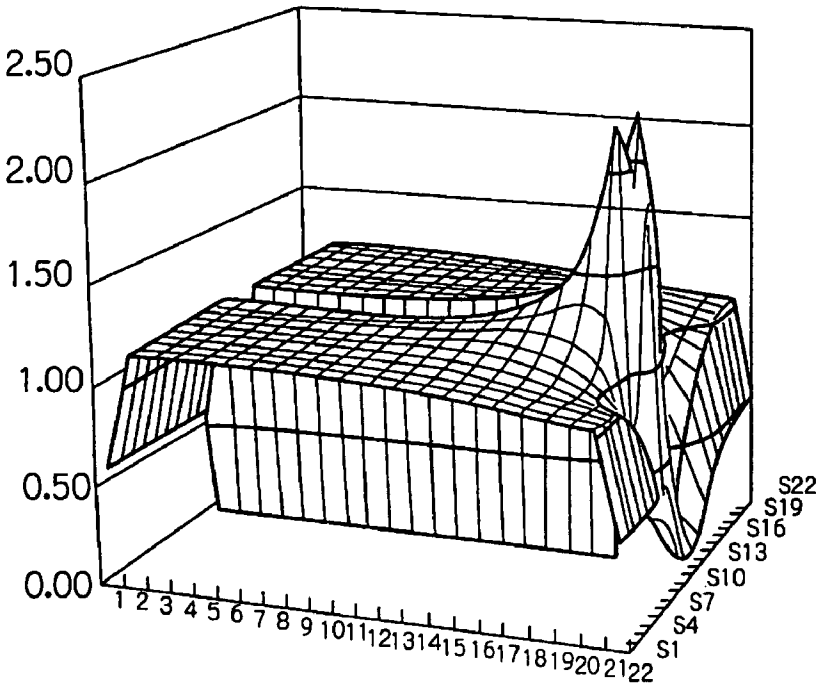
Figure 6B:
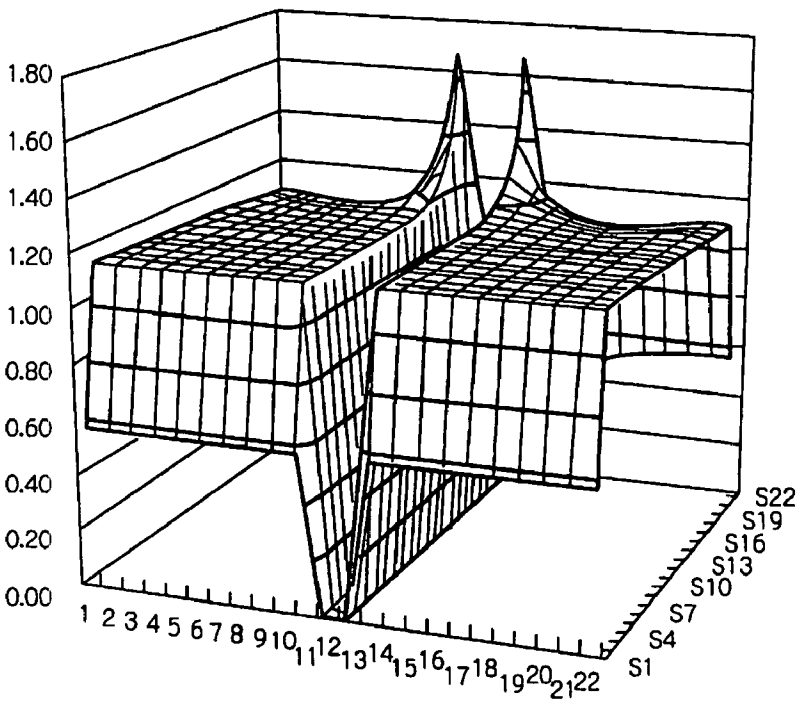
FIGS. 6A and 6B are diagrams showing the distribution of calorific value. These diagrams were obtained from a sample in which the spacing D1 is 1.5 μm.
Figure 6A:
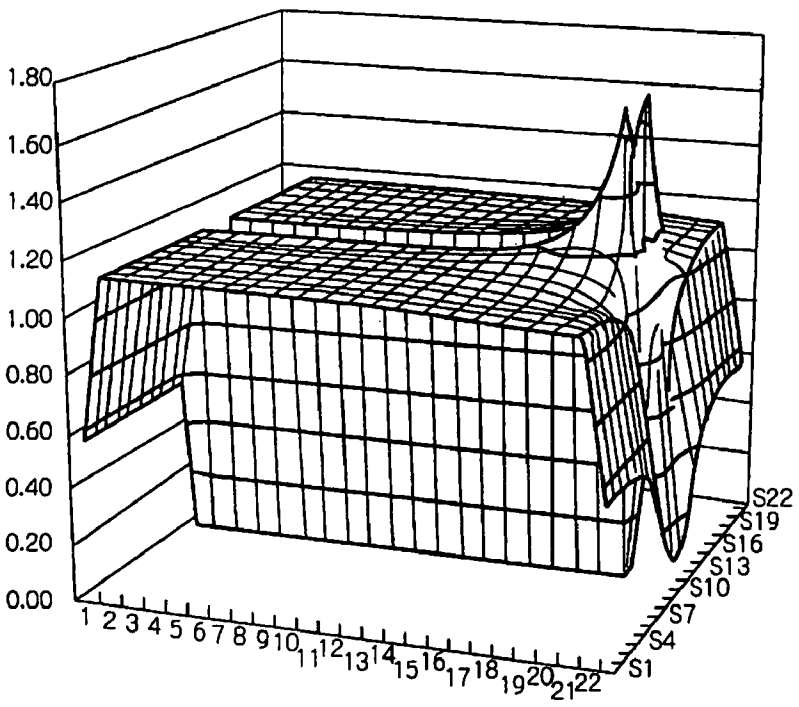

FIGS. 4A and 4B show resistance networks representing the heat evolving element 22. FIG. 4A shows the entire structure and FIG. 4B shows an equivalent circuit for analysis. The one shown in FIG. 4A consists of unit resistors of tetragonal lattice, with the entire region assuming a square and the central part (corresponding to the slit 22*c*) removed.

The heat evolving element 22 according to this embodiment has the following dimensions. Spacing D1 is 2.5 μm. Spacing D2 is 21 μm. Spacing D3 is 2 μm. The overall width of the heat evolving element 22 is 20 μm. Incidentally, D2 is the distance between the electrode 36 (at the turnaround part) and electrodes 36 at the opposite, with the main heat evolving parts 22*a* and 22*b* interposed between them). In other words, D2 is substantially the length (in vertical direction) of the main heat evolving parts 22*a* and 22*b* in FIG. 3. D3 is the width of the slit 22*c*.

It is assumed that a voltage of 2V is applied across the electrodes A and B of the resistor network. The electric potential is balanced and hence is zero at the central part of the spacing D1. This may be represented by an equivalent circuit shown in FIG. 4B. This equivalent circuit denotes that the voltage (V) is applied to the electrode A or B on the assumption that all the zero points connected together are at the ground potential.

This analysis gave the current distribution which permits the calculations of electric power generated by individual resistors. The thus calculated distribution of power consumption or heat evolution (in terms of ratio) is shown in FIGS. 5A and 5B and FIGS. 6A and 6B. The result in FIGS. 5A and 5B was obtained from a sample in which the spacing D1 is 2.5 μm, and the result in FIGS. 6A and 6B was obtained from a sample in which the spacing D1 is 1.5 μm. Incidentally, these figures show the distribution of heat evolution on the heat evolving element 22 but do not show the distribution of actual temperatures.

Figure 7:
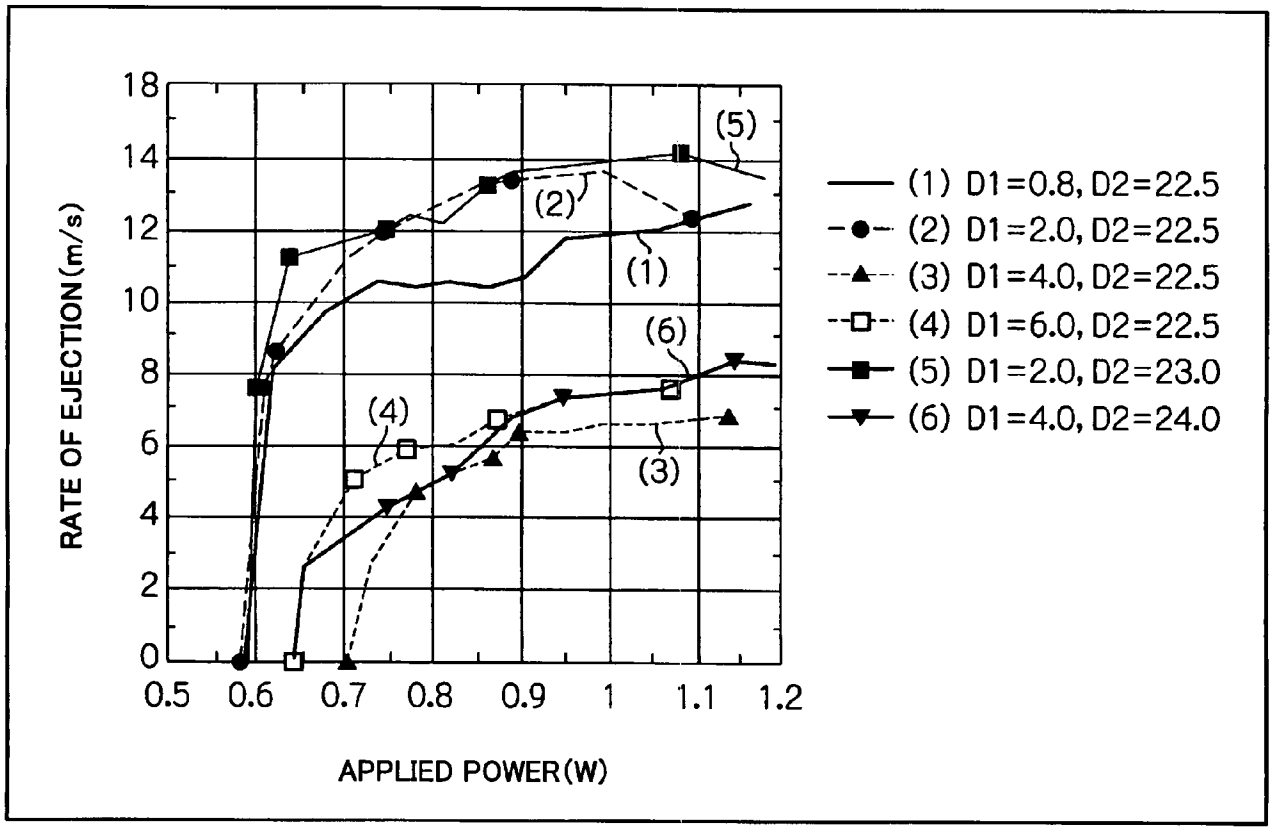
FIG. 7 is a graph showing the relation between the applied electric power (W) and the rate of ink ejection (m/s), with the spacing D1 and D2 (shown in FIGS. 6A and 6B) varied.

The relation between the applied electric power (W) and the rate of ink ejection (m/s) varies depending on dimensions of the spacing D1 and D2 (in FIG. 3) as shown in FIG. 7. The dimensions of the spacing D1 and D2 used in the experiment are as follows.

$$D1=0.8\ \mu m,\ D2=22.5\ \mu m \quad (1)$$

$$D1=2.0\ \mu m,\ D2=22.5\ \mu m \quad (2)$$

$$D1=4.0\ \mu m,\ D2=22.5\ \mu m \quad (3)$$

$$D1=6.0\ \mu m,\ D2=22.5\ \mu m \quad (4)$$

$$D1=2.0\ \mu m,\ D2=23.0\ \mu m \quad (5)$$

$$D1=4.0\ \mu m,\ D2=24.0\ \mu m \quad (6)$$

In the six experiments mentioned above, the spacing D3 was kept constant at 0.8 μm.

The results of experiments show that the sample with the spacing D1 of 2.0 μm is better than that with the spacing D2 of 0.8 μm in the rate of ink ejection by about 15 to 20%. It is also noted that the rate of ink ejection is much lower in the case of samples having the spacing D1 of 4.0 μm or larger.

Further experiments were carried out to find the optimal length of the spacing D1. To this end, the relation between the electric power applied to the heat evolving element 22 and the rate of ink ejection was investigated and the heat-evolving spots on the heat evolving element 22 was observed, with the length of the spacing D1 varied.

Figure 8:
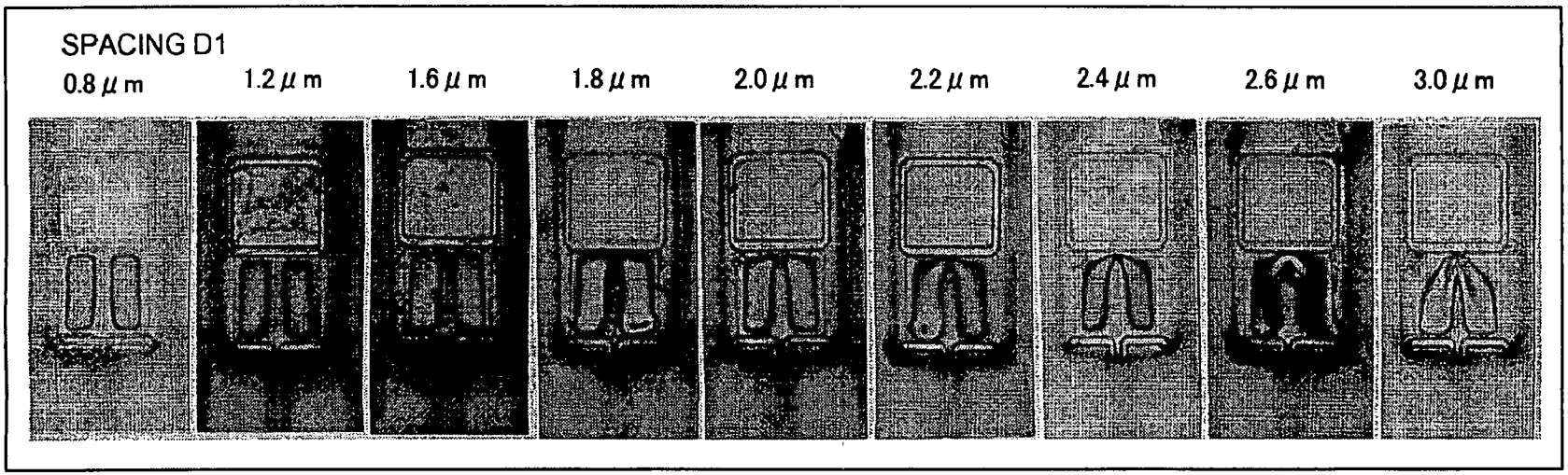
FIG. 8 is a set of optical microphotographs showing the heat evolution by heating elements, with the spacing D1 varied from 0.8 μm to 3.0 μm.

FIG. 8 is a set of optical microphotographs showing the heat evolution of the heating elements 22 (when the heating elements 22 are baked), with the spacing D1 varied from 0.8 μm to 3.0 μm and the spacing D2 kept constant at 20 μm.

It is noted from FIG. 8 that the shape of heat evolving spot remains almost the same for the spacing D1 of 0.8 to 1.2 μm but begins to expand upward as the spacing D1 exceeds 1.6 μm. With the spacing D1 of 2.2 μm and larger, the heat evolving spot assumes an inverted U-shape because current flowing through the spacing D1 predominates. As the result, the substantial area of heat evolving spots (or the area of the main heat evolving parts 22*a* and 22*b*) decreases. With the spacing D1 of 2.6 μm and lager, the concentrated current is observed in the spacing D1.

Figure 9:
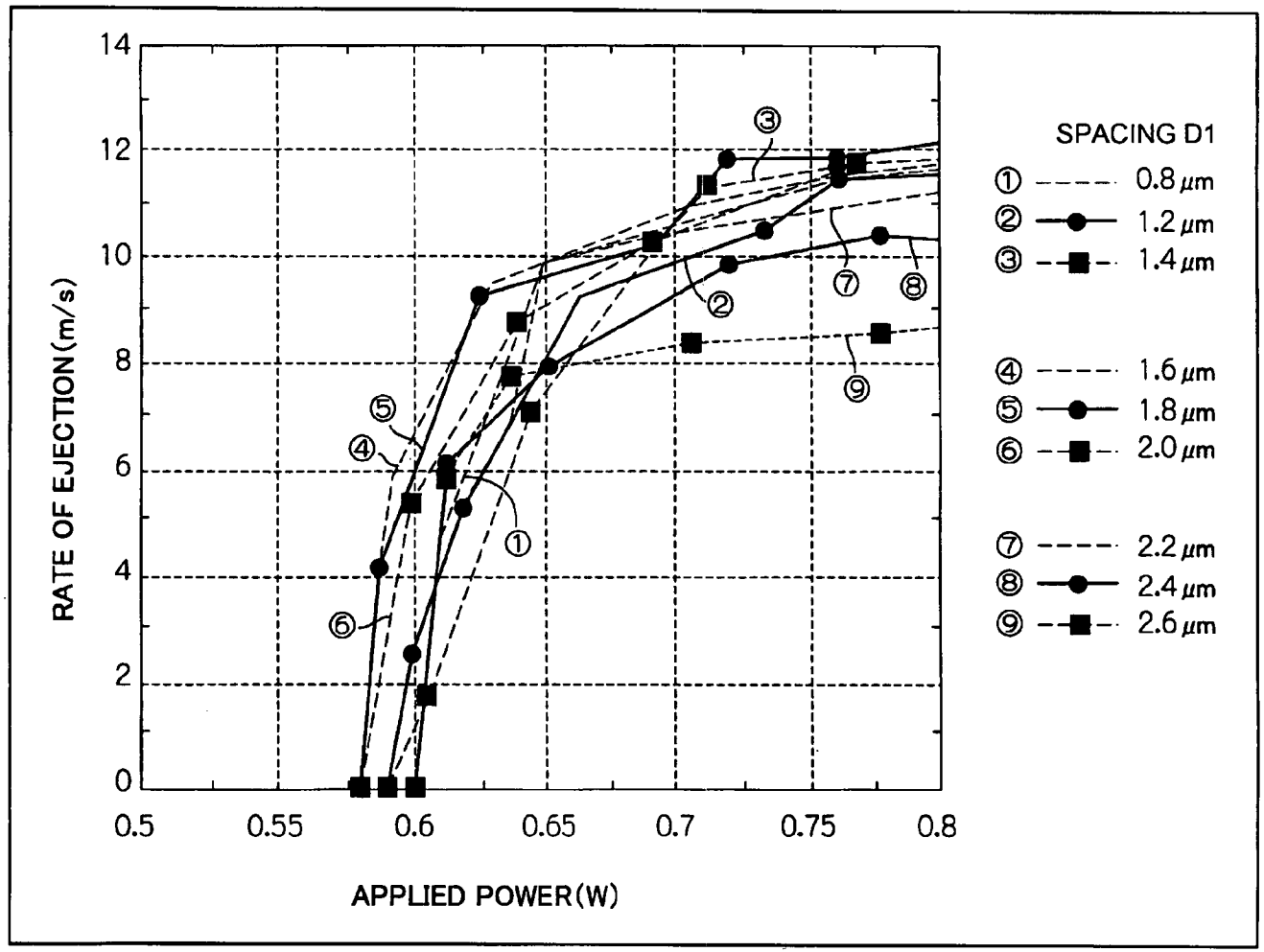
FIG. 9 is a graph showing the relation between the applied electric power (W) and the rate of ink ejection (m/s), with the spacing D1 varied from 0.8 to 2.6 μm.

FIG. 9 shows the relation between the applied electric power (W) and the rate of ink ejection (m/s) that was observed in samples, with the spacing D1 varied from 0.8 to 2.6 μm.

It is noted from FIG. 9 that the samples do not greatly vary in ejection characteristics so long as the spacing D1 is in the range of 0.8 to 1.4 μm. However, the samples with the spacing D1 in the range of 1.6 to 2.0 μm get the high rate of ejection soon with a smaller amount of electric power. This is attributable to the heating spot that expand toward the spacing D1. By contrast, the samples with the spacing D1 of 2.2 μm and above are as slow as those with the spacing D1 in the range of 0.8 to 1.4 μm to get the same rate of ejection. With the spacing D1 increasing to 2.4 and 2.6 μm, the rate of ejection decreases for the same amount of electric power. The reason for this is that the current passing through the spacing D1 predominates, as apparent from the heating spots shown in FIG. 8, with the result that the substantial area of heating spot decreases and the amount of heat energy transmitted to ink decreases.

Figure 10:
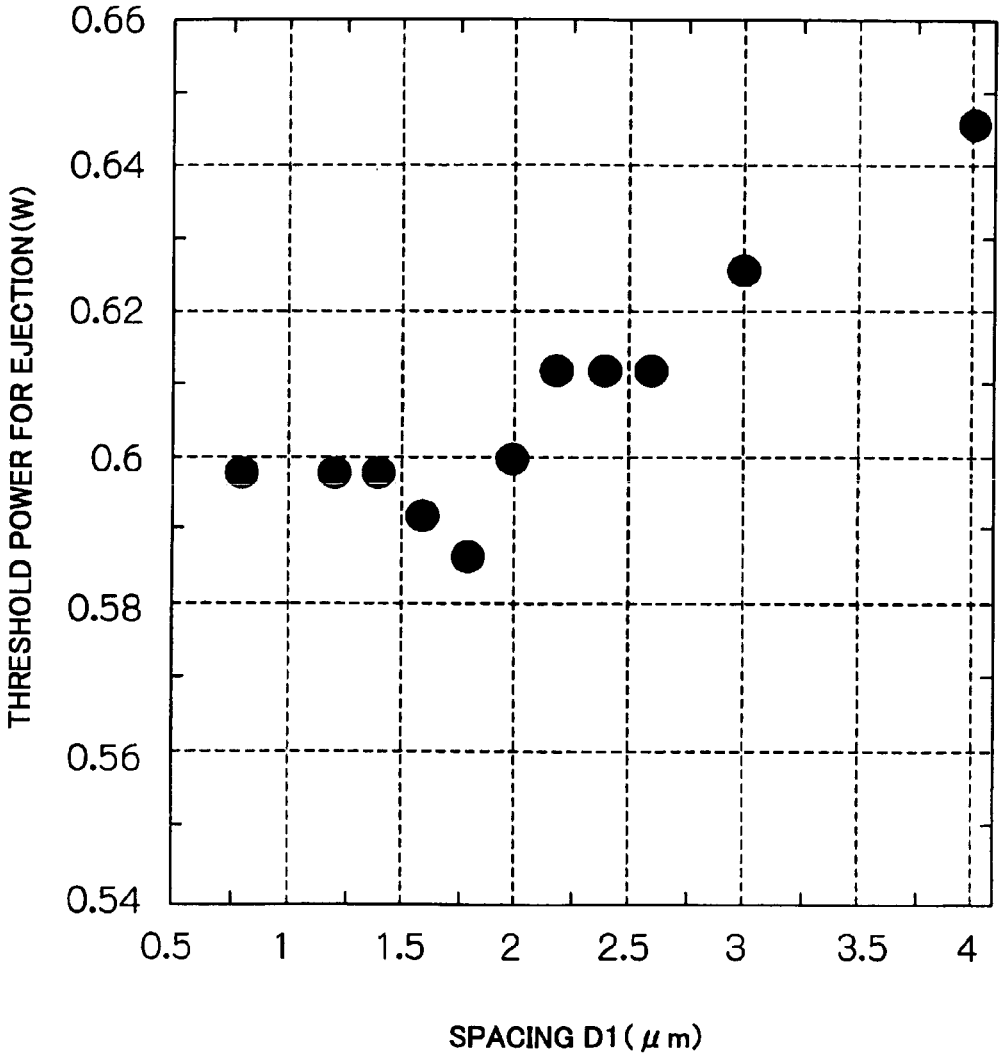
FIG. 10 is a graph showing the relation between the spacing D1 and the electric power to start ejection.

FIG. 10 is a graph showing the relation between the spacing D1 and the electric power to start ejection. It is noted from FIG. 10 that a large amount electric power is required to start ejection as the spacing D1 exceed 2.0 μm, and the electric power to start ejection becomes minimal when the spacing D1 is about 1.8 μm.

It is concluded from the foregoing that the spacing D1 of the heat evolving element 22 should be in the range of 1.6 to 2.0 μm if the spacing D2 is 20 μm. In other words, the spacing D1 should be 0.08 to 0.1 times the spacing D2.

In this embodiment, ink ejection is controlled in the following manner.

The head 21 has the primary control means and the secondary control means for ink ejection control.

The primary control means causes the heat evolving element 22 to evolve heat energy, thereby ejecting ink above the heat evolving element 22 from the nozzle 44.

The secondary control means causes the two main heat evolving means 22*a* and 22*b* to evolve heat energy in different manner, thereby varying the distribution of heat energy imparted to ink above the heat evolving element 22 and controlling the direction of ink ejection from the nozzle 44.

In the related-art technology, ink ejection is controlled only by the primary control means (that performs ON and OFF), whereas in the present invention the primary control means is supplemented with the secondary control means that controls the direction of ink ejection.

Figure 11:
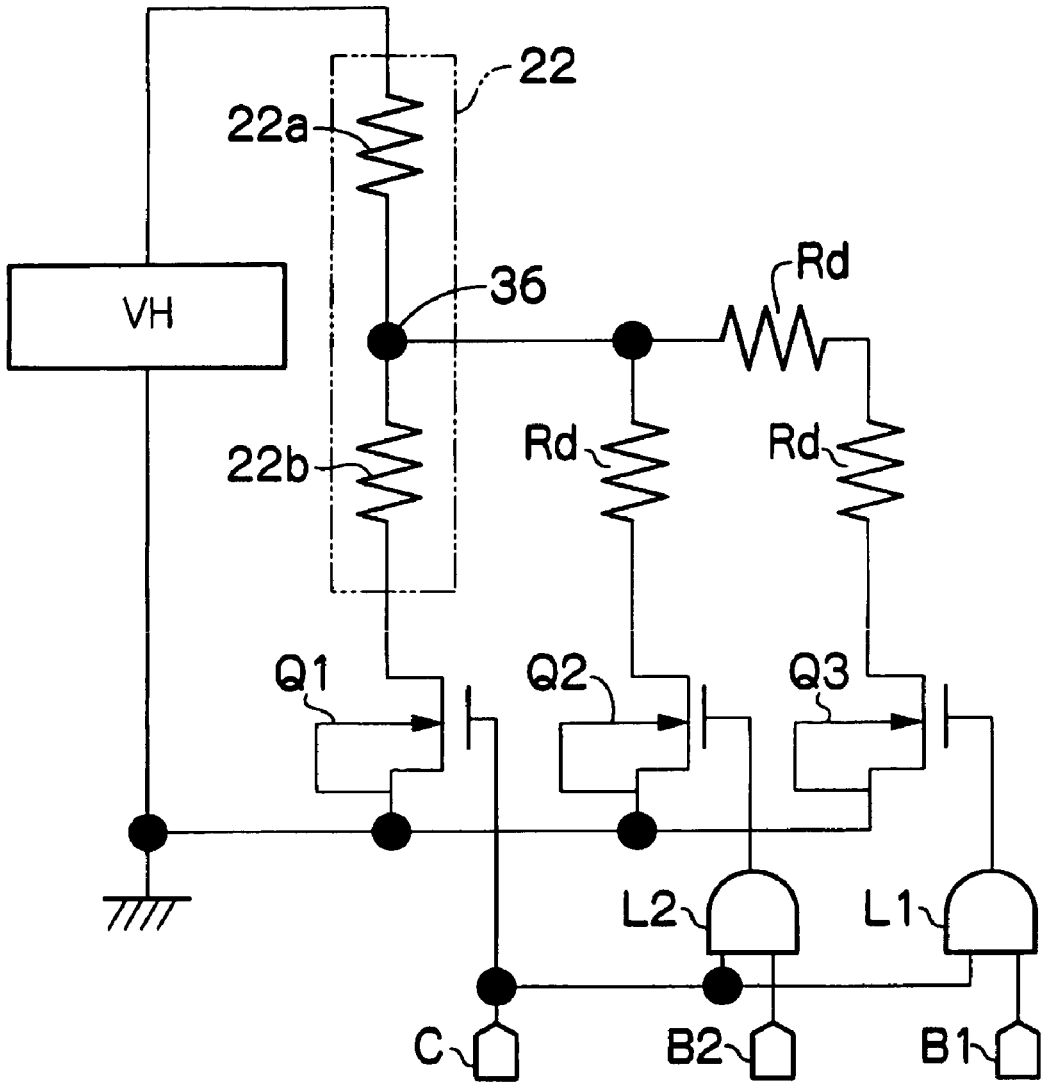
FIG. 11 is a schematic diagram showing the primary and secondary control means.

FIG. 11 is a schematic diagram showing the primary and secondary control means. The example shown here employs 2-bit control signals so as to set the current flowing through the main heat evolving parts 22*a* and 22*b* at four levels. This means that the direction of ink ejection is varied in four steps.

According to this embodiment shown in FIG. 11, the resistance of the main heat evolving part 22*a* is smaller than that of the main heat evolving part 22*b*. In addition, the heat evolving parts 22 are constructed such that current flows out of the electrode 36 which is formed at the middle (the turnaround point) between the main heat evolving parts 22*a* and 22*b*. In addition, the three resistors Rd are intended to deflect the direction of ink ejection. The transistors Q1, Q2, and Q3 function as switches for the main heat evolving parts 22*a* and 22*b*.

Symbol "C" represents a component to enter a binary control signal (with current representing "1"). Symbols L1 and L2 represent AND gates to enter binary values. Symbols B1 and B2 represent components to enter binary signals "0" or "1" into the AND gates (L1 and L2). Incidentally, the AND gates L1 and L2 are supplied with power from the power source VH.

When signals representing C=1 and (B1, B2)=(0, 0) are entered, the transistor Q1 becomes active but the transistors Q2 and Q3 remain idle (and hence no current flows through the three resistors Rd). At this time, current in equal amounts flows through the main heat evolving parts 22*a* and 22*b*. In this situation, the main heat evolving part 22*a* evolves a less amount of heat than the main heat evolving part 22*b* because the former has a smaller resistance than the latter. With this setting, the direction of ink ejection is deflected leftward, so that ink drops head toward the left end.

When signals representing C=1 and (B1, B2)=(1, 0) are entered, current flows through the two resistors Rd connected in series to the transistor Q3 but no current flows through the resistor Rd connected to the transistor Q2. As the result, the amount of current flowing through the main heat evolving part 22*b* is smaller than that in the foregoing case (with (B1, B2)=(0, 0)). However, in this case, too, the main heat evolving part 22*a* evolves a less amount of heat than the main heat evolving part 22*b*. With this setting, the direction of ink ejection is deflected leftward, but ink drops head slightly rightward than in the foregoing case.

With input signals representing C=1 and (B1, B2)=(0, 1), current flows through the one resistor Rd connected in series to the transistor Q2 but no current flows through the two resistors Rd connected to the transistor Q3. As the result, the amount of current flowing through the main heat evolving part 22*b* is much smaller than that in the foregoing case (with (B1, B2)=(1, 0)). However, in this case, the main heat evolving parts 22*a* and 22*b* evolve the same amount of heat. With this setting, the direction of ink ejection is not deflected at all.

With an input, C=1 and (B1, B2)=(1, 1), current flows through the three resistors Rd connected to the transistors Q2 and Q3. As the result, the amount of current flowing though the main heat evolving part 22*b* becomes smaller than that in the case of an input (B1, B2)=(0, 1). In this case, the main heat evolving part 22*a* evolves a larger amount of heat than the main heat evolving part 22*b*. In this state, the direction of ink ejection is deflected rightward.

The values of resistance of the main heat evolving parts 22*a* and 22*b* and the resistors Rd are properly adjusted so that the direction of ink ejection is changed according as the input (B1, B2) takes different values, (0, 0), (1, 0), (0, 1), and (1, 1), as mentioned above.

In this way it is possible to make ink drops to hit the printing paper at four different places (total of four; one through the projectile perpendicular to the printing paper, two at the left side, and one at the right side). Any one position can be chosen according to the two input values of B1 and B2.

The effect of the foregoing is that in the case where ink drops do not head the desired position due to fabrication defects in the head 21, the direction of ink ejection can be corrected by the secondary control means so that ink drops head the desired positions. In addition, properly deflecting the direction of ink ejection from the nozzles 44 improves the printing quality.

Although one embodiment of the present invention has been mentioned above, the present invention is not limited to it but can be variously modified.

Figure 12:
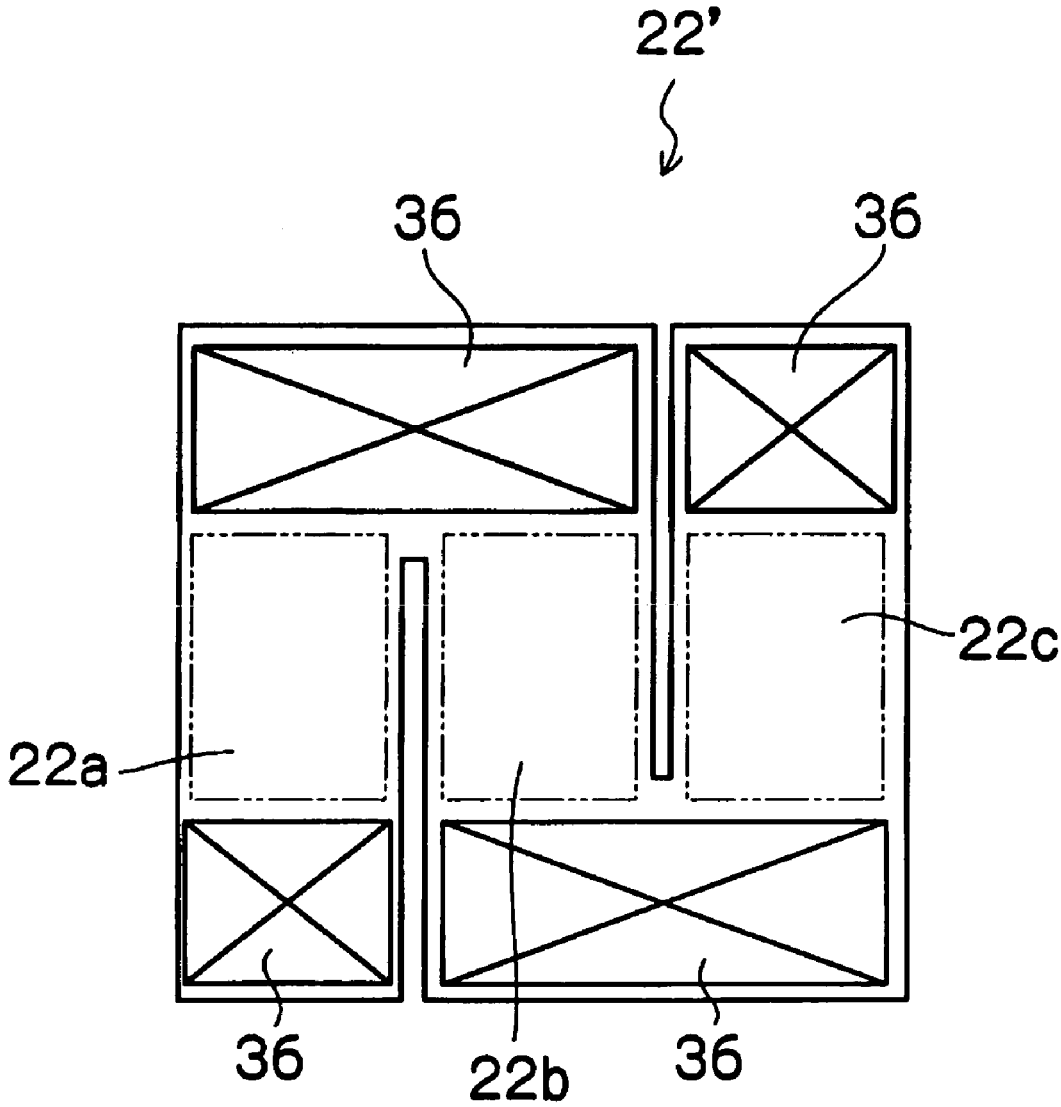
FIG. 12 is a plan view showing another embodiment of the heating element.

For example, the heat evolving element 22 may have three or more main heat evolving parts (not limited to two) which are arranged in a zigzag pattern in plan view. In such a case, the electrodes may be formed by leaving a spacing (corresponding to the spacing D1) in the turnaround parts. Such a modified embodiment of the heat evolving element 22' is shown in FIG. 12, in which three main heat evolving parts 22*a* to 22*c* are formed on one substrate.

INDUSTRIAL APPLICABILITY

According to the present invention, the heat evolving element on a single substrate can be divided into a plurality of heat evolving parts. This structure is equivalent to forming heat evolving parts connected in series by conductors. The heat evolving parts are made to evolve heat in individually controlled amounts by specifying the position of the conductor on the heat evolving element.

Moreover, the primary control means is supplemented with the secondary control means so that heat energy is evolved in different manners and hence the direction of ink ejection from the nozzle is controlled.

The invention claimed is:

1. A liquid ejecting head, having:

at least one heat-energy evolving element constructed in a pattern with at least one bend and that evolves heat energy to eject liquid, said bend dividing said heat-energy evolving element into at least two heat evolving regions;

conductors connected to said heat evolving regions and to said bend; and a nozzle through which the liquid is ejected associated with each heat-energy evolving element, wherein, said conductor connected to said bend is a distance $D_1$ from said bend and a distance $D_2$ from said other conductors connected to said heat evolving regions, where $D_1$ is 0.08 to 0.10 times the distance of $D_2$.

2. A liquid ejecting head having:

at least one heat-energy evolving element constructed in a pattern with at least one U-shape and that evolves heat energy to eject liquid, said U-shape dividing said heat-energy evolving element into at least two heat evolving regions;

conductors connected to said heat evolving regions and to said U-shape; and a nozzle through which liquid is ejected associated with each heat-energy evolving element, wherein, said conductor connected to said U-Shape is a distance $D_1$ from said U-shape and a distance $D_2$ from said other conductors connected to said heat evolving regions, where $D_1$ is 0.08 to 0.10 times the distance of $D_2$.

3. A liquid ejecting head having:

at least one heat-energy evolving element constructed in a pattern with at least one slit and that evolves heat energy to eject liquid, said slit dividing said heat-energy evolving element into at least two heat evolving regions;

conductors connected to said heat evolving regions and to said slit; and a nozzle through which liquid is ejected associated with each heat-energy evolving element, wherein, said conductor connected to said slit is a distance $D_1$ from said slit and a distance $D_2$ from said other conductors connected to said heat evolving regions, where $D_1$ is 0.08 to 0.10 times the distance of $D_2$.

4. A liquid ejecting apparatus having:

at least one heat-energy evolving element constructed in a pattern with at least one bend and that evolves heat energy to eject liquid, said bend dividing said heat-energy evolving element into at least two heat evolving regions;

conductors connected to said heat evolving regions and to said bend;

a nozzle through which liquid is ejected associated with each heat-energy evolving element; and a controller including a primary control means which causes said heat-energy evolving element to evolve heat energy, thereby ejecting-liquid on said heat-energy evolving element through said nozzle and a secondary control means which, upon control of a current flowing through at least the two parts, causes a difference in heat energy characteristics amongst at least the two parts and changes the distribution of heat energy imparted to the liquid by said heat-energy evolving element, thereby controlling the direction of the liquid ejected from said nozzle.

5. A liquid ejecting apparatus having:

at least one heat-energy evolving element constructed in a pattern with at least one U-shape and that evolves heat energy to eject liquid, said U-shape dividing said heat-energy evolving element into at least two heat evolving regions;

conductors connected to said heat evolving regions and to said U-shape;

a nozzle through which liquid is ejected associated with each heat-energy evolving element; and a controller including a primary control means which causes said heat-energy evolving element to evolve heat energy, thereby ejecting the liquid on said heat-energy evolving element through said nozzle and a secondary control means which, upon control of a current flowing through at least the two parts causes a difference in heat energy characteristics amongst at least the two parts and changes the distribution of heat energy imparted to the liquid by said heat-energy evolving element, thereby controlling the direction of the liquid ejected from said nozzle.

6. A liquid ejecting apparatus having:

at least one heat-energy evolving element constructed in a pattern with at least one slit and that evolves heat energy to eject liquid, said slit dividing said heat-energy evolving element into at least two heat evolving regions;

conductors connected to said heat evolving regions and to said slit;

a nozzle through which liquid is ejected associated with each heat-energy evolving element; and a controller including a primary control means which causes said heat-energy evolving element to evolve heat energy, thereby ejecting liquid on said heat-energy evolving element through said nozzle and a secondary control means which causes at least the two parts to evolve heat energy differing in heat energy characteristics thereby changing the distribution of heat energy imparted to the liquid on said heat-energy evolving element, and controlling the direction the liquid ejected from said nozzle.

7. A liquid ejecting head having:

at least one heat-energy evolving element having at least two heat evolving regions that evolve heat energy to eject a liquid;

at least three conductors connected to said heat evolving regions;

a nozzle through which liquid is ejected by the heat energy associated with each heat-energy evolving element, wherein, one of the conductors connected to said heat evolving region is located a distance $D_1$ from said heat evolving region and a distance $D_2$ from said other conductors connected to said heat evolving regions, where $D_1$ is 0.08 to 0.10 times the distance of $D_2$.

8. The liquid ejecting head of claim 7, wherein said heat-energy evolving element regions can be selectively differentially energized.

9. The liquid ejecting head of claim 7, comprising a plurality of said nozzles and a plurality of said heat-energy evolving elements.

10. The liquid ejecting head of claim 7 wherein said pattern generally defines a U-shape, and legs of said U-shape comprise said heat evolving regions.

11. A liquid ejecting head comprising:

at least one nozzle through which liquid can be ejected;

a heat-energy evolving element associated with each said nozzle, said heat-energy evolving element comprising a pattern including at least two heat evolving regions; and at least three conductors connected to said heat-energy evolving element so that said heat evolving regions can be separately energized, wherein, said heat-energy evolving regions can be separately or jointly energized by selective application of electrical power via said conductors.

* * * * *